US009435134B2

(12) United States Patent
Walmsley

(10) Patent No.: US 9,435,134 B2
(45) Date of Patent: Sep. 6, 2016

(54) SELF-RAKING FENCE PANEL AND RAIL, KIT OF PARTS, AND METHOD OF ASSEMBLY AND INSTALLATION

(75) Inventor: Roger Walmsley, Ashby de la Zouch Leicestershire (GB)

(73) Assignee: CRH FENCING & SECURITY GROUP (UK) LTD (GB)

( * ) Notice: Subject to any disclaimer, the term of this patent is extended or adjusted under 35 U.S.C. 154(b) by 524 days.

(21) Appl. No.: 12/520,735

(22) PCT Filed: Dec. 20, 2007

(86) PCT No.: PCT/GB2007/050772

§ 371 (c)(1),
(2), (4) Date: Jun. 22, 2009

(87) PCT Pub. No.: WO2008/078116

PCT Pub. Date: Jul. 3, 2008

(65) Prior Publication Data

US 2010/0044662 A1 Feb. 25, 2010

(30) Foreign Application Priority Data

Dec. 22, 2006 (GB) ..... 0625622.6

(51) Int. Cl.
*B21F 27/00* (2006.01)
*E04H 17/16* (2006.01)
*E04H 17/14* (2006.01)

(52) U.S. Cl.
CPC ..... *E04H 17/1443* (2013.01); *E04H 17/1439* (2013.01); *E04H 2017/1491* (2013.01); *Y10T 29/49826* (2015.01)

(58) Field of Classification Search
CPC ..... E04H 17/1439; E04H 17/1443; E04H 2017/1491; Y10T 29/49826
USPC ..... 256/19, 21, 22, 34, 59–64, 65.01, 256/65.11, 65.12, 67, DIG. 1, DIG. 2; 403/109.2, 109.3, 109.6, 109.1
See application file for complete search history.

(56) References Cited

U.S. PATENT DOCUMENTS 2,145,172 A * 1/1939 Gustafson ..... 256/22
2,218,953 A * 10/1940 Gustafson ..... 256/22

(Continued)

FOREIGN PATENT DOCUMENTS

AU 2006202454 A1 1/2008
EP 1 316 657 A1 4/2003

(Continued)

OTHER PUBLICATIONS

PCT Search Report and Written Opinion, Apr. 2007.

(Continued)

*Primary Examiner* — Daniel P Stodola
*Assistant Examiner* — Nahid Amiri
(74) *Attorney, Agent, or Firm* — Fay Sharpe LLP

(57) ABSTRACT

A self-raking fence panel (1) comprises a pair of invert, U-shaped rails (30), each having a horizontal central wall (32) with apertures (37) for receiving a plurality of pales (10), a pair of outer side walls (33), and rigid or resilient, integral internal return walls (34, 134) defining downwardly diverging ramped surfaces (40, 135) and a pair of recesses (42, 136) adjacent each aperture. The pales are provided with spring biased pins (20) which are compressed by the ramped surfaces (40, 135) as the pale is pushed up through the respective aperture (37) until the pins lock in the recesses (42, 136). Alternatively, the pales may have rigid pins (26, 143) which urge the return walls (34, 134) outwardly as the pale is raised until the pins enter the recesses. The fence may be supplied as a kit of parts and assembled on site by fixing the rails (30) to the posts (2, 2'), setting the posts in the ground, and then populating the rails with the pales.

20 Claims, 11 Drawing Sheets

(56) References Cited

U.S. PATENT DOCUMENTS

| | | | | |
|---|---|---|---|---|
| 2,218,954 | A * | 10/1940 | Gustafson | 256/22 |
| 2,574,663 | A * | 11/1951 | Sampson | 249/72 |
| 3,340,592 | A * | 9/1967 | Carpenter | 29/229 |
| 4,050,828 | A | 9/1977 | Noro | |
| 4,140,297 | A | 2/1979 | Coleman, Jr. | |
| 4,140,298 | A | 2/1979 | Coleman, Jr. | |
| 4,373,310 | A * | 2/1983 | Dean | 52/182 |
| 5,443,244 | A | 8/1995 | Gibbs | |
| 5,454,548 | A * | 10/1995 | Moore | 256/22 |
| 5,660,378 | A | 8/1997 | Schall | |
| 5,873,564 | A * | 2/1999 | Bisch | 256/65.12 |
| 6,631,887 | B1 * | 10/2003 | Walmsley | 256/22 |
| 6,752,386 | B1 * | 6/2004 | Bundy | 256/65.12 |
| 6,802,565 | B2 * | 10/2004 | Isaacson | 297/410 |
| 7,086,642 | B1 | 8/2006 | O'Brien | |
| 7,347,412 | B1 * | 3/2008 | Zhu | 256/22 |
| 7,360,754 | B2 * | 4/2008 | Robbins | 256/65.12 |
| 7,635,115 | B2 * | 12/2009 | Lehmann | 256/65.12 |
| 7,677,535 | B1 * | 3/2010 | Lo | 256/65.08 |
| 7,819,390 | B2 * | 10/2010 | Godwin et al. | 256/22 |
| 2005/0199864 | A1 | 9/2005 | Gibbs et al. | |

FOREIGN PATENT DOCUMENTS

| | | |
|---|---|---|
| EP | 1 538 283 A1 | 8/2005 |
| GB | 2 070664 A | 9/1981 |
| GB | 2 393 741 A | 7/2004 |

OTHER PUBLICATIONS

UK Search Report, GB0902883.8, Mar. 17, 2009.

* cited by examiner

SELF-RAKING FENCE PANEL AND RAIL, KIT OF PARTS, AND METHOD OF ASSEMBLY AND INSTALLATION

CROSS-REFERENCE TO RELATED APPLICATIONS

This application is a national stage entry of international application number PCT/GB2007/050772, having international filing date Dec. 20, 2007, which was published in English, and which claims priority to Great Britain patent application No. GB0625622.6, filed Dec. 22, 2006.

BACKGROUND OF THE INVENTION

This invention relates to fences assembled from so-called self-adjusting or self-raking panels, each comprising a plurality of pales supported by two or more rails.

Self-raking fence panels are arranged to permit the pales to be pivotably adjusted through a limited angular range with respect to the rails, so that the rails can be fixed between adjacent vertical posts and adjusted or "raked" to follow the slope of the ground. Once installed, it is important that the fence is as difficult as possible for unauthorised persons to dismantle, so that it can resist vandalism and, where required, provide a secure barrier. Preferably, the number and complexity of the component parts should be minimised, so as to reduce the cost of manufacture and assembly.

Since each pale is pivotably connected to the rails, a self-raking panel is inherently less rigid than a panel with welded joints. It is therefore particularly important to ensure that the panels do not sag under their own weight and that the pales do not rattle in the rails, since this can make the fence appear weak and untidy. For this reason an anti-sag support is often installed in the ground in the middle of each panel.

It is known to assemble self-raking panels by riveting each pale to a rail formed from an angled bar, so that the rivets form pivots about which each pale can move. However, the rivets must be inserted and closed one by one, which is slow and expensive, and are found to be vulnerable to removal by a cold chisel or by levering with a scaffold pole inserted between the pales after the fence is erected.

Moreover, such panels must be assembled in a factory and then transported to the site on which the fence is to be erected. Each panel may be, for example, 2.5 m or more in length and 50 kg or more in weight, and occupies considerably more volume during transportation than the sum of its individual components. Depending on the distance from the factory to the site, the cost of transportation may considerably increase the cost of the finished fence.

Once on site, the site must be carefully measured and the posts erected so that the correct spacing is maintained between each pair of adjacent posts to receive the pre-assembled panels. Moreover, the weight of each panel may cause serious injury to fingers trapped between the rails and the pales, particularly in the aperture through which each pale passes, as the panel is raked. It is therefore desirable to install pre-assembled panels using specially trained workers, which further increases cost, especially where the fence is to be installed at a significant distance from the factory.

GB 2 435 055 (published after the priority date of the present application) discloses a self-raking fence panel comprising a plurality of fence members (pales) which are received in tubular rails of hollow box section. A deformable support member, comprising a length of resilient channel section with converging side walls, is inserted into the rail prior to assembly of the pales, and engages a dowel inserted into each pale to retain the pale in the rail. After installation, the pale is free to move longitudinally in the rail.

In alternative embodiments GB '055 proposes that a support member may be integrally formed with a rail, and the rail itself may comprise a channel section with a portion of one or both side walls that either converge or diverge, which side walls are resiliently urged apart.

U.S. Pat. No. 2,218,954 discloses a fence panel in which the rail itself is formed as a flexible channel section in which the lower portions are inturned to resiliently engage the pickets (pales). The rails are first installed in position, and then the pickets are inserted one by one through apertures in the rails so that the side walls are resiliently urged apart so as to engage in slots in the pales.

The posts, rails and pales can thus be transported in bundles to the site, where the posts and rails are erected before inserting the pales into the rails. However, once the fence is assembled there is little to prevent it from being dismantled by reversing the procedure. Moreover, the use of inherently flexible, deformable rails can be expected to reduce the rigidity of the finished panel.

A more rigid and secure self-raking panel having pales with fixed, transverse pins is available under the trade name "Atlas" (™) from Heras Nederland BV (www.heras.nl). Each rail is a hollow box section having aligned apertures spaced along its upper and lower walls. Each pair of apertures is provided with a tubular plastics sleeve which extends between the upper and lower walls of the rail to receive one of the pales. Each of the side walls of the sleeve is spaced apart from the adjacent outer side wall of the rail and is slotted to define a pair of resiliently deformable flaps and a hole for receiving one end of the transverse pin. Each pale is inserted through the corresponding sleeves in the upper and lower rails and then rotated so that the projecting ends of each fixed, transverse pin urge the flaps outwardly to accommodate the pin as it enters the holes.

Once in place, the pin is concealed within the rail and the pale is difficult to remove. However, the plastics inserts increase the component count and cost of the panel, and may be damaged by heat.

WO 02/072982 discloses a self-raking panel with rigid, invert, U-shaped rails, each defining a downwardly open channel in which the side walls are integral with inner, return walls which extend upwardly between the side walls. Pairs of recesses are formed in the upper edges of the inner return walls and aligned in the transverse direction of the rail. Each pale has at least one fixed transverse pin, and is inserted through an aperture in the top wall of each rail and then rotated so that the projecting ends of each pin enter the recesses. An angled locking bar is then inserted between an adjacent return wall and sidewall of the rail so that its upper leg occupies a gap between the upper edge of the return wall and the top wall of the rail, trapping the pins in the recesses.

The panel may be assembled on site by arranging the rails and pales on the ground and then inserting the locking bar from one end of each rail. In practice, the angled bar is found to be difficult to insert due to its length and the frictional resistance of the rail, so that factory assembly is preferred.

EP 1 016 768 B1 discloses a self-raking panel in which each of the tubular metal pales is fitted with a resilient clip whose ends extend through opposed openings in the pale wall to provide a pivot. The rail comprises a rigid, invert U-shaped channel having a horizontal top wall and inner return walls between the outer side walls. The pales are inserted through apertures in the top wall so that the openings in the pale wall are aligned with corresponding recesses in the return walls, which receive the ends of the clip. In practice it is found to be difficult to compress the clips by rotating the pale in the rails, so panels of this type are in practice assembled at the factory using a jig which aligns the pales with the rails before a specialist tool is used to insert the clips into the ends of the pales.

SUMMARY OF THE INVENTION

It is an object of the present invention to provide a rail for a self-raking fence panel, a self-raking fence panel incorporating the rail, and a kit of parts from which the panel may be assembled on site, which addresses the above mentioned problems. In particular, the panel should be easy to assemble, preferably on-site, yet should resist sagging and disassembly after installation. It is a further object to provide a method for assembling the panel and a method for installing a fence comprising such a panel.

According to the present invention there are provided a rail, a panel, a kit of parts, and corresponding methods of assembly and installation, in accordance with the appended claims.

In a first aspect the invention provides a rail having at least one integral return wall, preferably a pair of return walls, with recesses to receive locking projections on the pales and a ramped surface adjacent each recess, which assists the projection to enter the recess during assembly. Advantageously, the ramped surfaces comprise smoothly curved, converging opposed surfaces of the return walls. The projections may be resiliently biased or, alternatively, the rail may be resiliently deformable so as to accommodate either resilient or rigid projections. In a second aspect, the rail includes at least one integral return wall, preferably a pair of return walls, and is resiliently deformable so as to allow the locking projection on each pale to enter the recess in the return wall during assembly.

In both of its aspects the invention makes it possible to assemble the novel panel on site from a kit of parts, and also simplifies the installation of the fence posts and rails as further explained below, so that the installation may be accomplished by less skilled workers while avoiding the risk of injury (particularly trapped fingers) associated with handling heavy, self-raking panels after assembly. Following assembly, the projections are concealed within the rail so that it is difficult to remove a pale without destroying the panel. Advantageously, by providing a pair of return walls with smoothly curved opposed surfaces, it is found to be extremely difficult to dislodge a pale by inserting a crowbar or the like into the base of the rail, even where the rail is resiliently deformable to accommodate the projections on the pales during assembly, since the curved surfaces cause the crowbar to slip out of the rail without gaining a purchase.

The integral return walls, which preferably extend for most of the height of the side walls, i.e. for at least about 80% of the height of the side walls, and most preferably extend substantially to the central wall, have surprisingly been found in tests to confer so much rigidity to the installed panel that, even where the rail is resiliently deformable, it is usually unnecessary to use an anti-sag support. This is believed to be due to the fact that the entire rail is a unitary element formed integrally, preferably from a single piece of steel, which may be made surprisingly thin without causing the panel to sag. By clamping each pale between a pair of resilient return walls, the problem of rattle may also be entirely avoided.

Moreover, the open base between the return walls of the inverted, generally U-shaped rail permits the pales to be freely pivoted about the projections, which preferably restrain the pales against longitudinal movement in the rail. The novel rail may thus be made much deeper in its vertical dimension (having side walls for example of the order of 50 mm high) than would be possible for a tubular, box section rail, since such a deep box section rail would then require unacceptably large apertures in its lower wall in order to permit the pales to pivot, which apertures would necessarily create finger traps, and/or would require the pales to be free to move longitudinally in the rail after assembly, creating the perception of looseness and insecurity. This additional depth further helps the novel rail to avoid sagging, and also provides a longer ramped surface adjacent each recess, which makes it easier to insert the pale into the rail.

BRIEF DESCRIPTION OF THE DRAWINGS

Further features and advantages will be apparent from the following illustrative embodiments which will now be described, purely by way of example and without limitation to the scope of the invention, and with reference to the accompanying drawings, in which.

Corresponding parts are indicated by the same reference numerals in each of the figures.

DETAILED DESCRIPTION OF THE INVENTION

Figure 1:
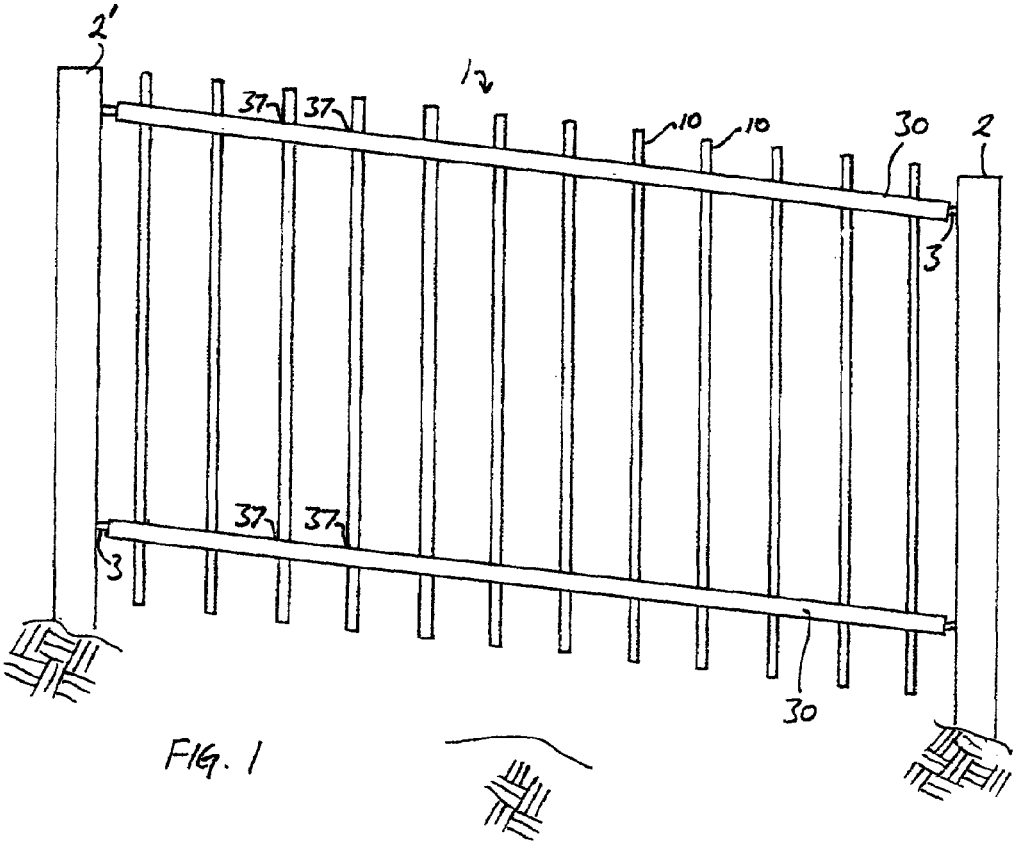
FIG. 1 shows a first fence panel forming part of a first fence, erected on sloping ground.

Referring to FIG. 1, a first self-raking fence panel 1 comprises a plurality of pales 10 supported by a pair of identical rails 30. The rails have a plurality of apertures 37 for receiving the pales, and are mounted between two vertical posts 2, 2' by conventional adjustable fixings 3. The pales are pivotably mounted in the rails, enabling the panel to be raked as shown by adjusting the rails to lie parallel with the slope of the ground.

Figure 2A:
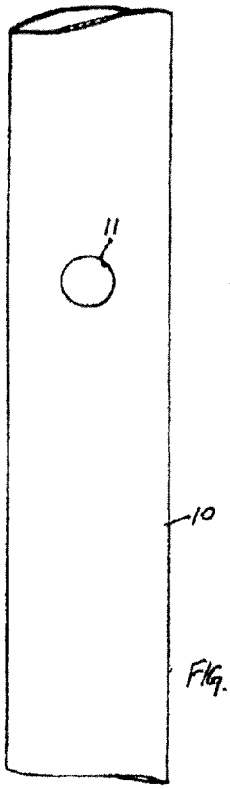
FIG. 2A shows a first pale of the first fence panel before insertion of the spring assembly.
Figure 2C:
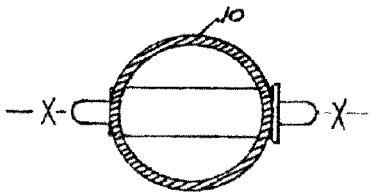
FIGS. 2B and 2C are respectively side and cross-sectional views of the first pale after insertion of the spring assembly.
Figure 2B:
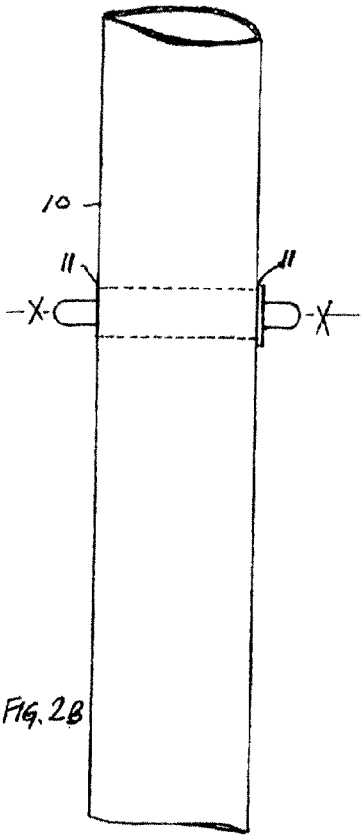

Referring to FIGS. 2A-2C and FIGS. 3A-3C, each pale 10 comprises a steel tube with a pair of opposed apertures 11 formed in the wall of the tube along a transverse axis X-X of the pale so as to form a cross-bore. An insert, comprising a spring assembly 20 is adapted to be inserted into the cross-bore via the apertures 11 so that it lies along the transverse axis X-X of the pale. The spring assembly comprises a tubular body 21 which supports a pair of projections 22; the projections are resiliently biased outwardly from the ends of the body 21 by an internal spring 23, so that they can be compressed axially to the position shown in FIG. 3A and afterwards return to the extended position shown in FIG. 3C. A collar 24 is formed on one end of the body 21, so that the spring assembly can be accurately positioned by simply inserting it through the apertures 11 until the collar abuts the pale wall as shown in FIG. 2B.

Figure 3A:
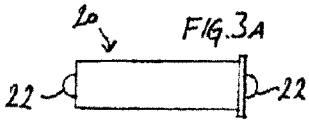
FIG. 3A shows the spring assembly in the compressed condition.
Figure 3B:
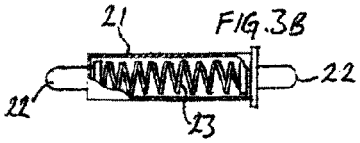
FIGS. 3B and 3C are respectively cutaway and side views of the spring assembly.
Figure 3C:
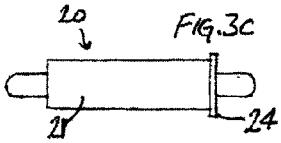
Figure 3E:
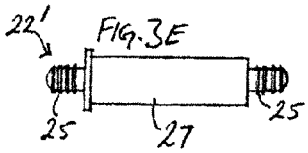
FIG. 3E shows a rigid pin.
Figure 3D:
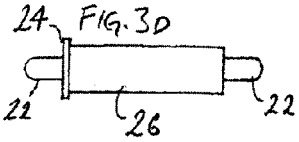
FIG. 3D shows a second spring assembly.

Referring to FIG. 3D, each insert may alternatively comprise a rigid pin 26, which may be turned from a solid steel bar as shown or alternatively may be a roll pin or the like. The rigid pin 26 has a collar 24 corresponding to that of the spring assembly 20, so that it can be easily inserted into the cross-bore 11 of the pale 10 during on-site assembly of the fence.

Referring to FIG. 3E, in a development, a rigid pin 27 comprises projections 22' which are each provided with a locking formation, such as a series of backward facing annular barbs 25, which engages the inner edge of the respective recess in the rail after the rejection 22' has entered into it, as further described below. This resists any attempt to remove the projection from the recess after assembly, such as by means of a pry bar inserted into the base of the channel between the resilient inner side walls.

Figure 4A:
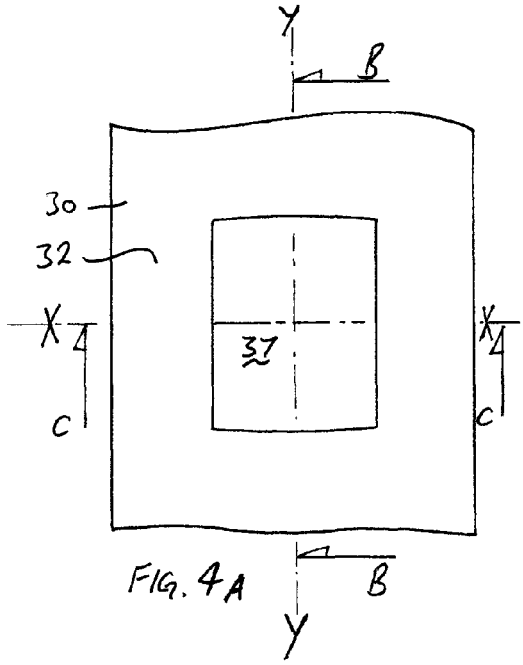
FIG. 4A is a plan view of part of a first rail of the first fence panel.
Figure 4B:
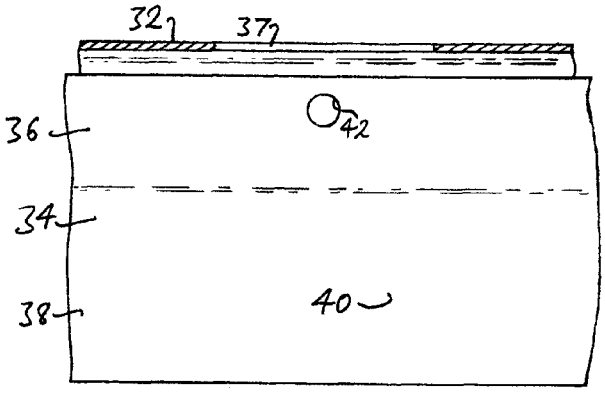
FIG. 4B is a section through the longitudinal axis Y-Y of the first rail, seen in the direction of arrows B.
Figure 4C:
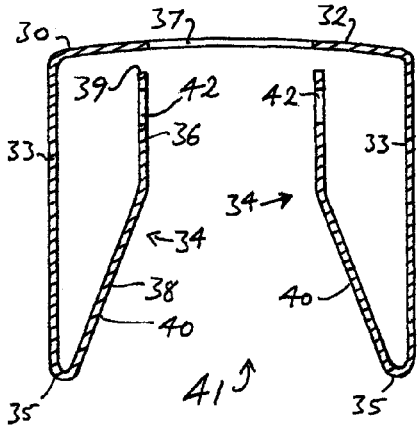
FIG. 4C is a section through the transverse axis X-X of the first rail, seen in the direction of arrows C.

Referring to FIGS. 4A-4C, each rail 30 comprises a generally U-shaped elongate steel section, having a central wall 32 (which is preferably arranged at the top of the rail) and two integral side walls 33 extending from it in opposed relation as shown. The side walls are extended to form two integral return walls 34 which are joined to the side walls by bend regions 35; the return walls are arranged between the side walls and extend up inside the rail towards the central wall 32.

A plurality of apertures 37 are formed in the central wall 32 to receive the pales. The shorter dimension of each aperture 37 lies along the transverse axis X-X of the rail and is slightly greater than the diameter of the pale 10 (or, where a non-round pale is preferred, its corresponding transverse dimension), while the longer dimension of the aperture 37 lies along the longitudinal axis Y-Y of the rail and accommodates the slight displacement of the pale as the panel is raked.

Each return wall 34 comprises an upper section 36 which lies parallel with the adjacent outer side wall 33, and a lower section 38 which is angled to form an inwardly facing ramped surface 40. The two opposed ramped surfaces 40 extend axially along the rail 30 adjacent the recesses 42 and converge upwardly (in the normal assembled position of the rail as shown) towards the central wall 32 so as to define a downwardly facing, downwardly widening channel 41.

A pair of recesses 42 are formed adjacent each aperture 37 to receive the projections 22 about which the respective pale is pivoted. Each respective recess is formed in the upper section 36 of one of the return walls 34, so that the two recesses 42 lie on opposite sides of the aperture 37 along the transverse axis X-X of the rail.

In the embodiment shown, each recess 42 is a hole punched in the return wall 34, but in alternative embodiments it might be formed for example by notching the upper edge 39 of the return wall 34 so that the projection is retained in the notch by the central wall 32, or alternatively by depressing a section of the return wall, or by cutting and bending a tab which remains attached to the rail. In this specification, the term "recess" embraces any hole, cavity or depression suitable for receiving the corresponding projection of the pale.

The rail 30 may be roll formed from steel, which may be as little as, for example, from about 1.2 mm to about 1.6 mm in thickness, so that the return walls 34 are resilient and are deflected by the projections 22 during assembly so as to allow the projections 22 to enter the recesses 42 as further described below.

Figure 5A:
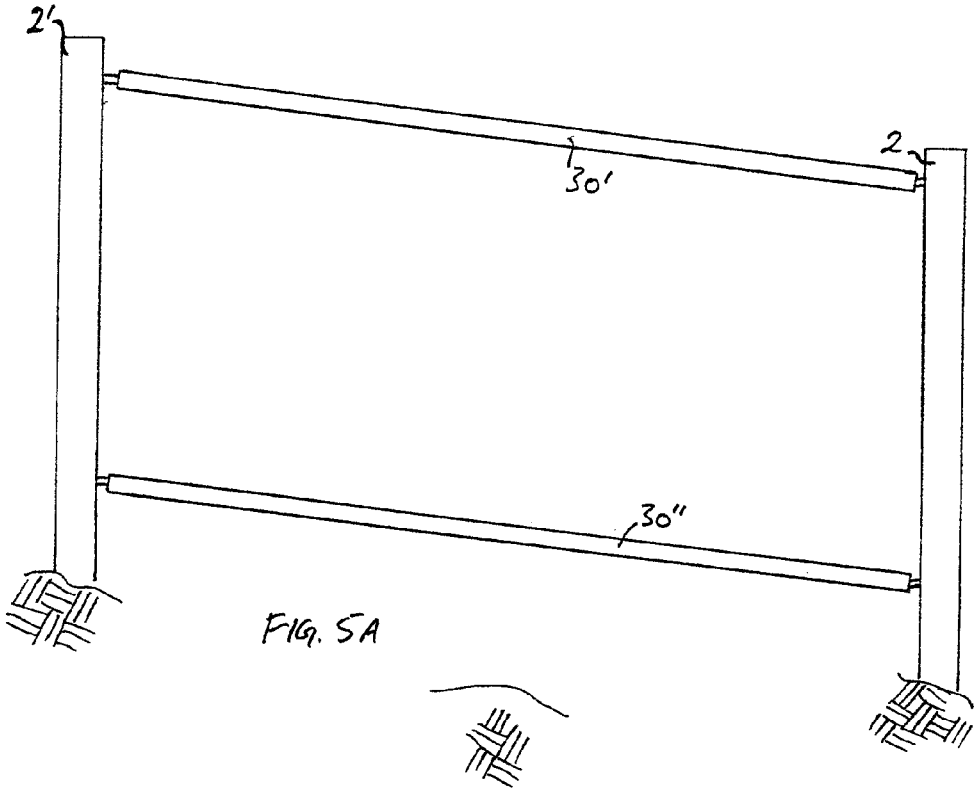
FIGS. 5A-5D show respectively four consecutive steps in the assembly and installation of the first panel and fence.

Referring to FIG. 1, FIGS. 5A-5D, and FIGS. 6A-6C, the first fence is installed by setting a first post 2 in the ground (for example, by concreting it into a hole). A second post 2' is then placed in its approximate position and one or more rails 30 are then attached between the two posts and adjusted (raked) to lie parallel with the ground surface. The second post 2' is then concreted in place (FIG. 5A). If preferred, both posts may be set in place at the same time, after attaching the rails. In either case, the attached rails negate the requirement to measure accurately the distance between the posts, so that the posts can be installed by less skilled workers. The procedure may be repeated for each adjacent panel, until a row of posts 2 is in place, linked by rails 30.

Figure 5B:
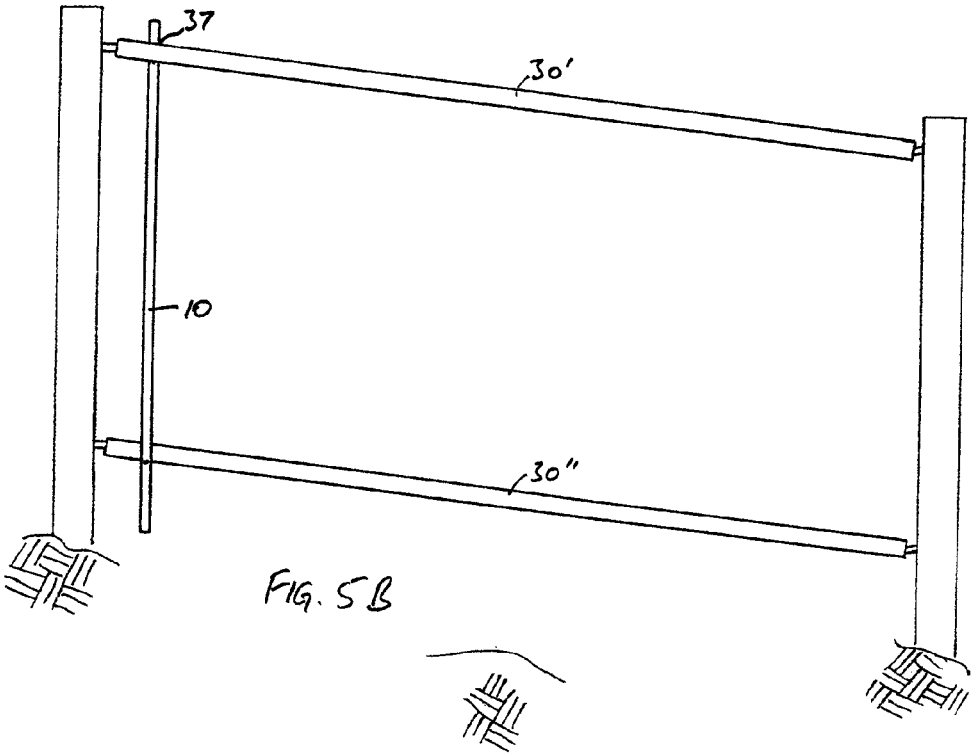
Figure 5C:
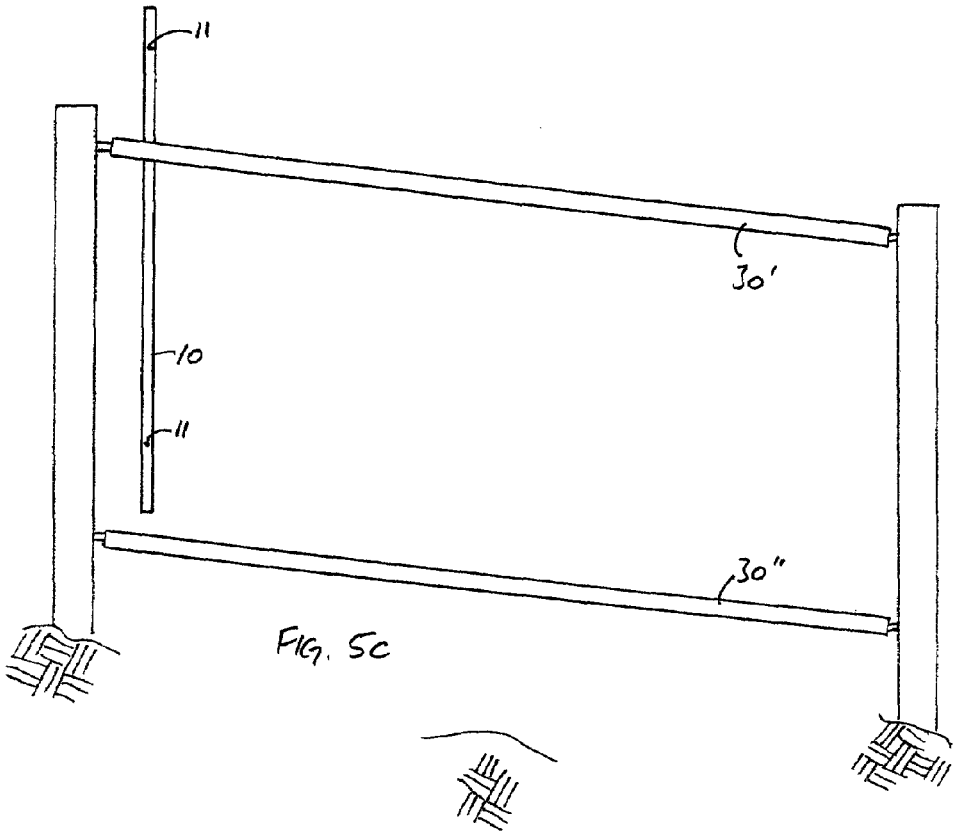
Figure 6A:
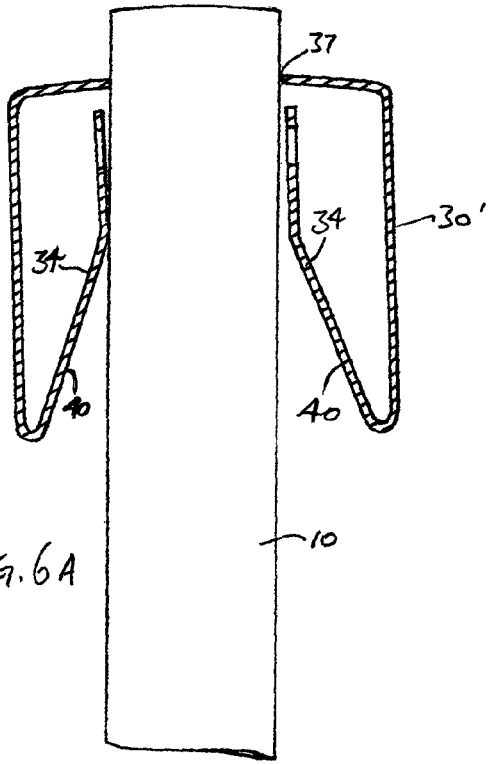
FIGS. 6A-6F are cross sections of the first rail showing various stages of assembly.

A first pale 10 is then inserted upwardly through a first aperture 37 in the upper rail 30', so that its lower end lies outside the lower rail 30" (FIG. 5B). In this position the pale 10 is slanted laterally in the upper rail 30', as shown in FIG. 6A, which is made possible by the downwardly diverging ramped surfaces 40 which provide room for slight sideward adjustment of the pale, as well as by the resilient flexibility of the return walls 34.

Figure 5D:
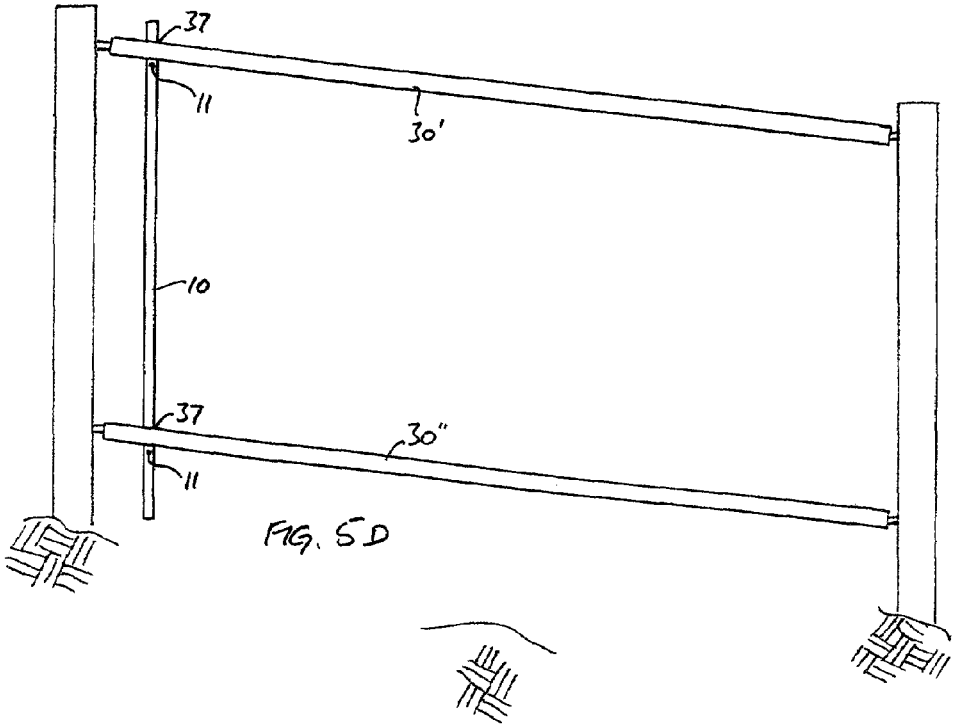

The pale 10 is then displaced axially upwards (FIG. 5C) so that its lower end is positioned between the upper 30' and lower 30" rails, before its lower end is inserted downwardly through the corresponding aligned aperture 37 in the lower rail 30" (FIG. 5D).

The foregoing steps make it very easy for the workers to install the posts and rails and then insert the pales into the rails, while standing on the ground.

Figure 6B:
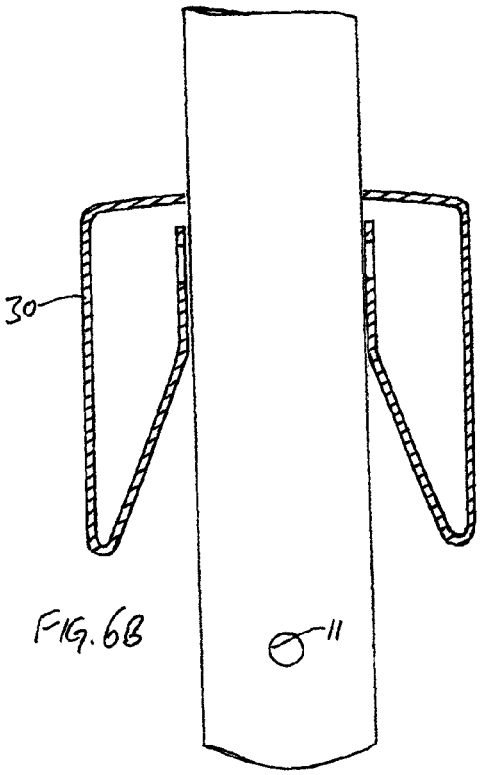

The pale is positioned as shown in FIG. 5D so that each aperture 11 in the pale lies outside the adjacent rail (FIG. 6B). In the example shown, each pale has two pairs of apertures 11, defining two cross-bores, so that it can be attached to both the upper and lower rails 30 by two pairs of projections 22. This makes it still more difficult to remove the pale after installation.

Figure 6C:
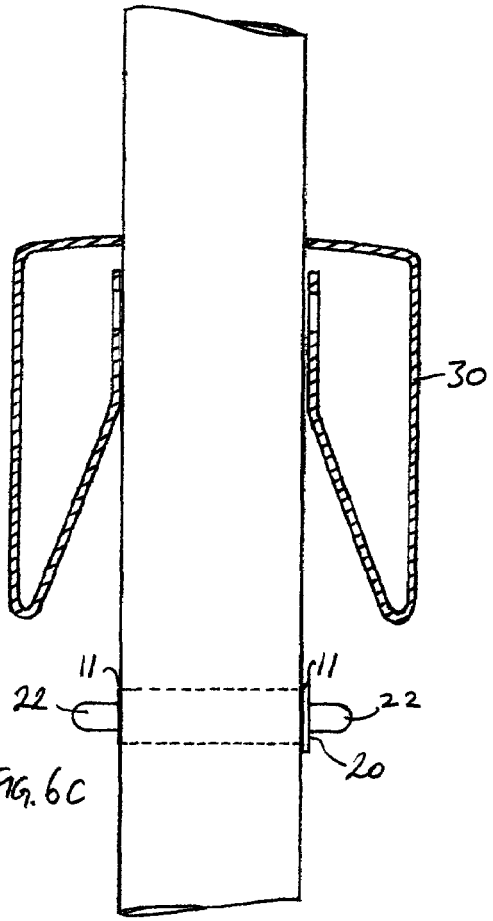
Figure 6D:
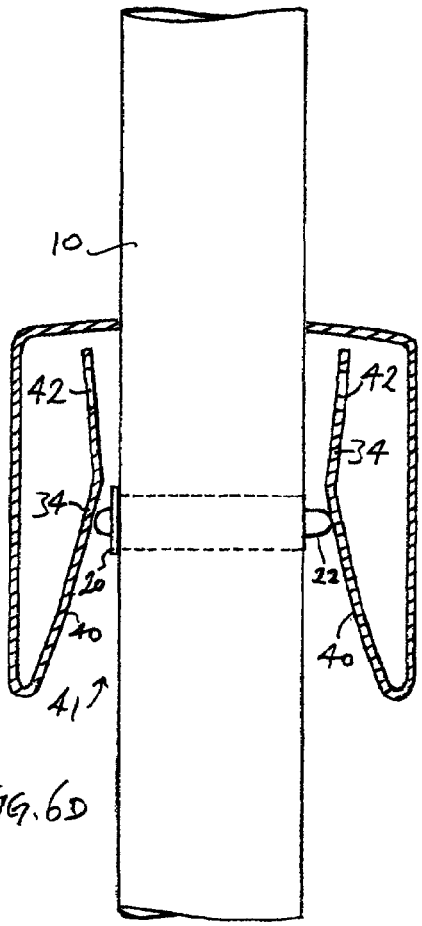

An insert, which may be resiliently biased, such as the spring assembly 20 as shown in the embodiment illustrated, or may alternatively be rigid, such as the rigid pin 26, is then inserted into each cross-bore of the pale via the apertures 11 so that its ends project laterally from the pale to form projections 22 (FIG. 6C). The pale is then displaced axially upwards (FIG. 6D) so that the projections 22 enter the channel 41 in the rail and progressively engage the ramped surfaces 40.

The ramped surfaces 40 engage the opposite axial ends of each projection 22 and urge the projections 22 into the pale 10 as the pale is progressively displaced axially upwards, while the projections 22 at the same time progressively urge the return walls 34 resiliently outwards as shown to accommodate the insert.

Figure 6E:
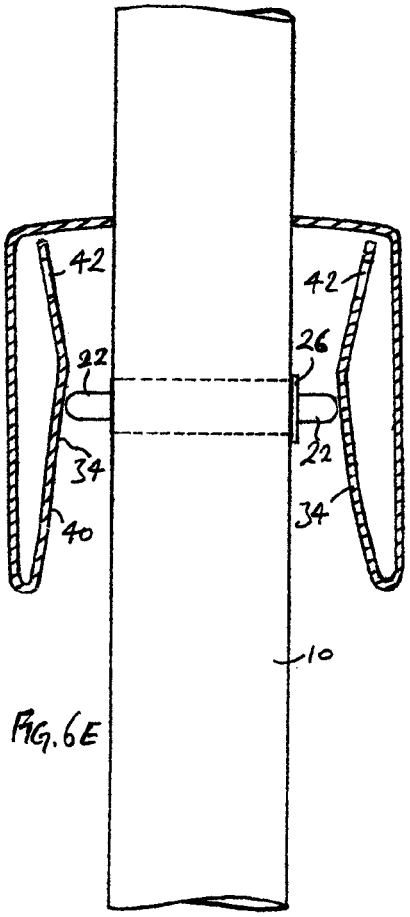
Figure 6F:
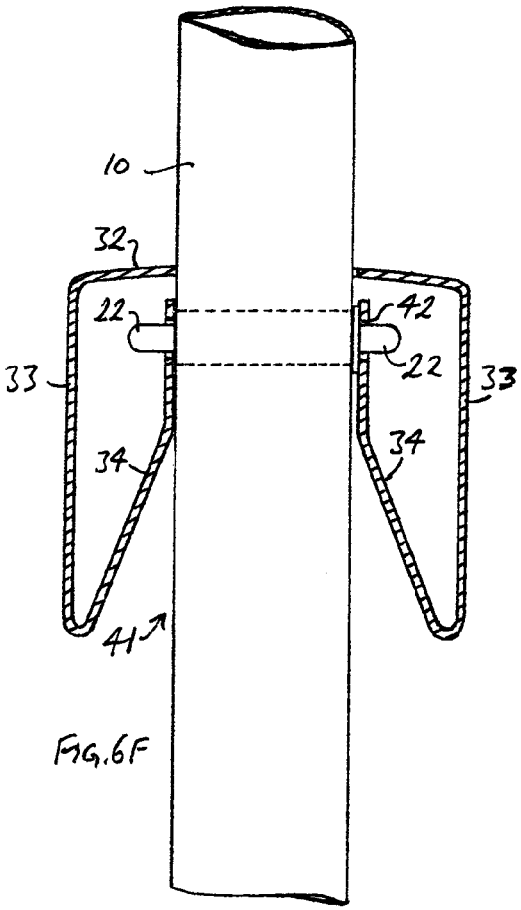

Referring to FIG. 6F, when the spring assembly reaches the recesses 42, the projections 22 spring out into the recesses 42 and at the same time the return walls 34 spring back into their rest position as shown. The pale is now in its final assembled position as shown in FIG. 1, and the remaining pales are installed in the same way. Each pale is pivotably adjustable in the rail, which is to say that it may be inserted vertically through the corresponding apertures in the two rails and engaged with the rails in its installed position, irrespective of the slope of the rails within the range of adjustment provided by the panel.

The fence may thus be delivered to the site as a kit of parts, comprising the pales, rails and inserts (rigid pins or spring assemblies), together with the posts, and assembled and installed by local workers without the risks associated with handling the fully assembled panels. Of course, if preferred, each panel could also be assembled following a similar procedure by laying the rails out in parallel on the ground, prior to mounting on the posts.

Referring to FIG. 6E, a rigid insert 26 may be used in place of a resilient pin, in which case the return walls 34 are arranged to be sufficiently resilient that they deflect to accommodate the full transverse width of the pin 26 as shown.

Once assembled (FIG. 6F), the projections 22 and recesses 42 are concealed within the rail by the central wall 32 and outer side walls 33, making it difficult to release the pale from the rail. In order to further resist attack, such as by a prising tool inserted into the channel 41, each projection 22 may be equipped with a locking formation, such as that shown in FIG. 3E, which engages the edge of the recess 42 after insertion and prevents the return wall 34 from being levered away from the pale 10.

Figure 7A:
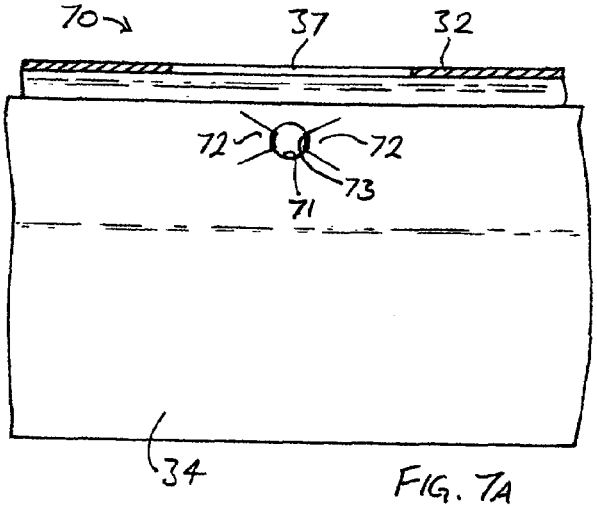
FIGS. 7A and 7B are respectively a longitudinal section and a cross section of a second rail.
Figure 7B:
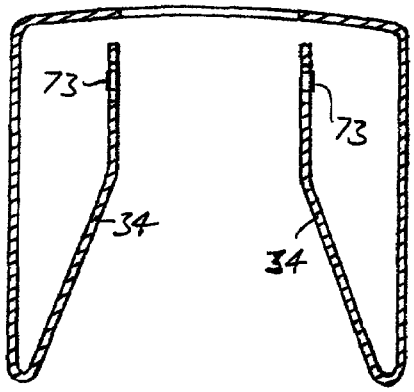

Referring to FIGS. 7A and 7B, a second rail 70 is formed similarly to the first but has recesses 71 which are provided with locking formations, comprising a pair of resilient tabs 72, each tab having a sharp, outwardly facing edge 73. The edges 73 of the tabs engage each respective projection 22 so as to resist removal of the projection from the recess 71 after assembly. If desired, locking formations may be employed on both the rails and the projections, so that they cooperate to lock the projections in place.

Figure 8A:
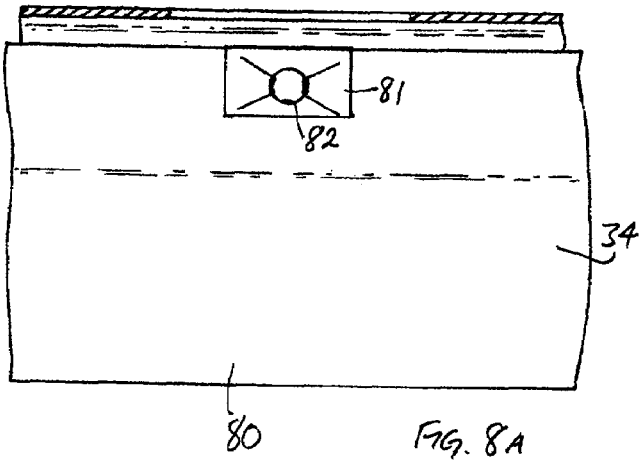
FIGS. 8A and 8B are respectively a longitudinal section and a cross section of a third rail.
Figure 8B:
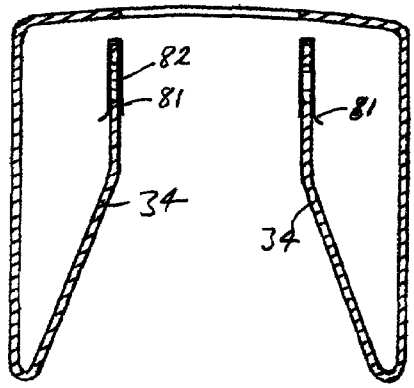

Referring to FIGS. 8A and 8B, a third rail 80 is formed with similar locking formations, which however are provided on clips 81 which are attached to the edges of the return walls 34 and cooperate with the recesses 82 to retain the projections 22 therein.

Many equivalent locking formations will be apparent to those skilled in the art.

Figure 9A:
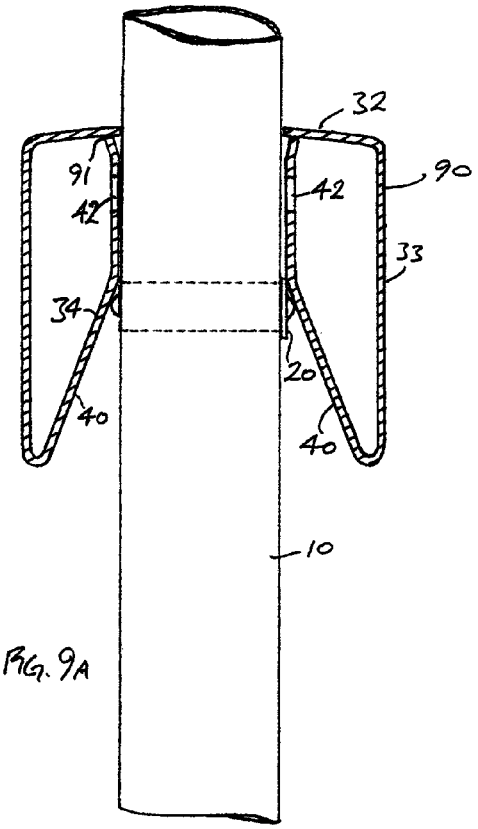
FIGS. 9A and 9B are cross sections of a fourth rail showing two consecutive stages of assembly.
Figure 9B:
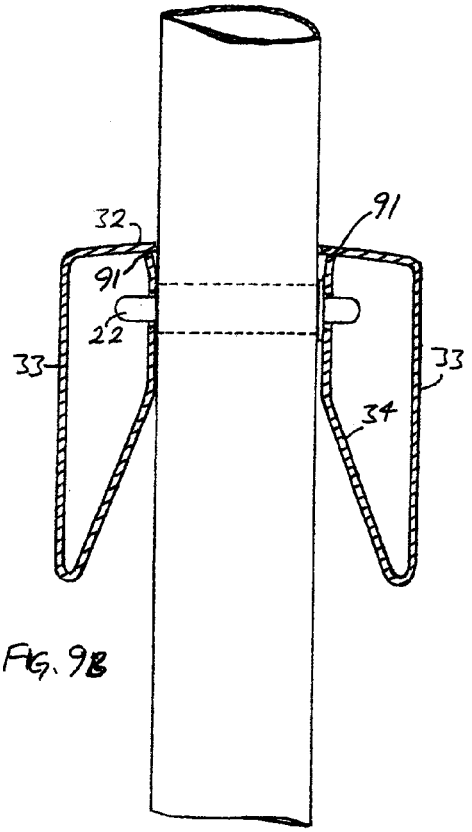

Referring to FIGS. 9A and 9B, a fourth rail 90 is formed similarly to the first rail, with ramped surfaces 40, but is not resiliently deflected by the projections 22. This is achieved by extending the upper edge 91 of each return wall 34 so that it contacts the central wall 32, by which it is supported so that it cannot move outwardly. In a development, the central wall 32 may be profiled so as to enhance its engagement with the edge 91.

The pale is fitted with a spring assembly 20 which rides up the ramped surfaces 40 (FIG. 9A), by which it is compressed, until the projections 22 enter the recesses 42.

In alternative embodiments, the return walls 34 may be supported by the side walls 33, for example, by forming tongues which extend outwardly from each return wall towards the side walls; or they may be supported by tongues which are pressed downwardly from the central wall 32. Alternatively, the rail may simply be formed from heavier gauge steel. In each case, the rigid rail makes it still more difficult to remove the pale by prising.

Figure 10:
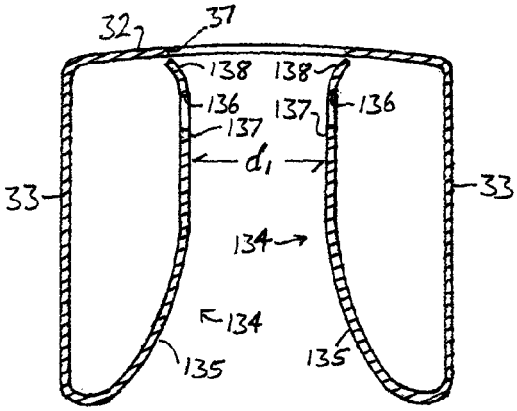
FIG. 10 is a cross section through a fifth rail.

Referring to FIG. 10, a fifth rail comprises an invert, generally U-shaped section similar to those described above, made for example by roll forming from thin, resilient steel, and having a central wall 32 and two integral side walls 33. A pair of internal return walls 134 extend integrally upwardly from the side walls substantially to the central wall 32. A plurality of apertures 37 are formed in the central wall 32 to receive the pales.

The return walls 134 converge towards the central wall 32 to define opposed ramped surfaces 135 which extend axially along the rail, and which function in use to engage the projecting opposite axial ends of each insert so as to assist the projections to enter a hole 136 in each return wall during assembly.

Figure 11:
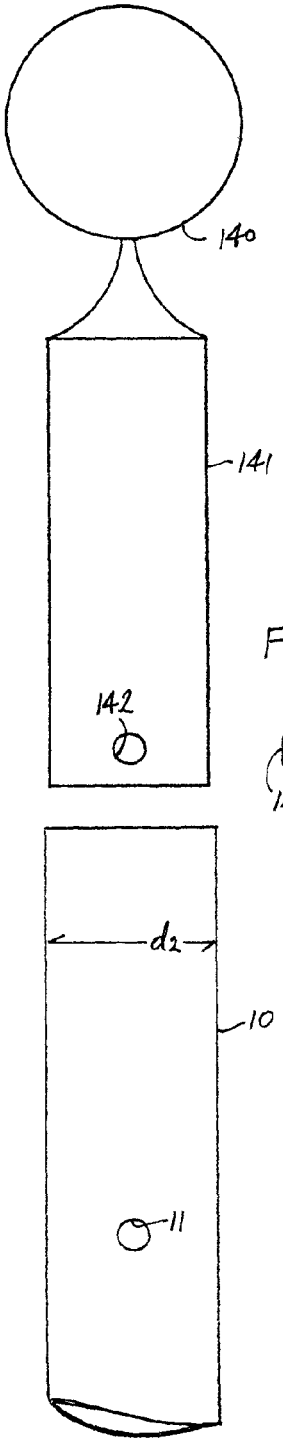
FIG. 11 is an exploded view of a pale assembly including a decorative finial.

The opposed ramped surfaces 135 are smoothly curved so that they do not offer any point of purchase for a prising tool. The curved ramped surfaces 135 transition smoothly into opposed parallel portions 137 in which the holes 136 are formed, and which are spaced apart at rest by a minimum distance $d_1$ which is less than the corresponding transverse dimension $d_2$ of the pale 10 (FIG. 11). As the pale 10 is inserted into the rail it urges the return walls 134 apart so that the pale remains resiliently gripped between the return walls after assembly, which completely prevents any rattling of the pales and makes the finished panel feel very solid.

The return walls 134 also define opposed, second ramped surfaces 138 adjacent the central wall 32, the second ramped surfaces diverging or flaring as shown towards the central wall. This is particularly convenient when installing bow top pales (not shown), each bow top pale comprising two parallel legs (each similar to a straight pale 10) joined at their upper ends by a curved portion. The lower ends of the two legs of each bow top pale are inserted downwardly through the upper rail through two adjacent apertures 37 so that they are received between the opposed second ramped surfaces 138, urging the return walls apart. The two legs of the pale are then passed down through the rail until their ends pass through the lower rail via the two corresponding apertures 37. Apertures 11 may be provided in only one of the two legs, each aperture being positioned below the respective rail so as to receive an insert, which may be a spring assembly (in which case the rail may be rigid), or (where the rail is resiliently deformable) a rigid peg or dowel. The bow top pale is then raised so that the opposite axial ends of each insert are progressively engaged by the ramped surfaces 135 of the return walls before engaging in the holes 136 in the two rails, leaving the curved upper end of the pale extending between the adjacent apertures 37 above the upper rail.

Referring to FIG. 11, a pale assembly comprises a round, tubular pale 10 together with a decorative finial 140, the finial having a stem 141 with a transverse hole 142. In use, the pale is inserted through the two rails so that the transverse hole 11 lies below the upper rail. The finial is then inserted into the upper end of the pale 10 so that its transverse hole 142 is aligned with the transverse hole 11 in the pale.

An insert comprising a solid peg 143, or alternatively a spring assembly as shown above, is then inserted through the aligned holes so that its two axial ends 143' project on either side of the pale, and the pale is raised so that the ends 143' of the insert urge the return walls 134 resiliently apart until the insert enters into the holes 136, locking the pale and the finial into the rail. It will be appreciated that this provides a very convenient way of assembling a fence with any combination of differently coloured or decorated finials and pales according to the requirements of each job.

Figure 12:
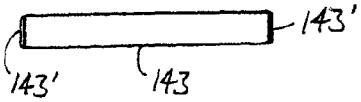
FIG. 12 is a longitudinal section through a sixth rail.
Figure 12:
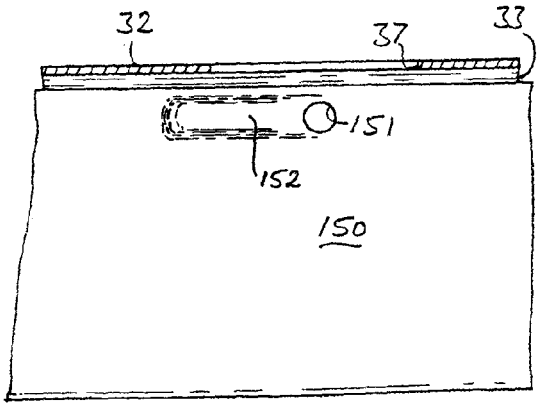

Referring to FIG. 12, a generally invert, U-shaped sixth rail comprises a central wall 32 with integral side walls 33 and inner return walls 150 extending integrally upwardly from the side walls. Similarly to the foregoing embodiments, the return walls are provided with holes (recesses) 151, arranged in pairs, one on either side of the rail adjacent the apertures 37 in the central wall, but unlike the foregoing embodiments, the return walls are generally parallel with the side walls. A ramped surface 152, comprising a curved, elongate guide surface pressed from the return wall is arranged adjacent each hole 151. Each pale 10 is inserted through the rail and aperture 37 and positioned with its insert between the holes 151 and generally aligned with the longitudinal axis of the rail. The pale is then rotated through 90° so that the opposite axial ends of the insert progressively engage the respective ramped surfaces 152 in the return walls, which curve spirally inwardly towards the longitudinal axis of the pale so as to guide the projecting ends of the insert into the holes 151. The return walls may be rigid, or alternatively may be resiliently deformable so that they are urged apart by the rotation of the insert until the projections engage in the holes 151, locking the pale into the rail. In alternative embodiments, the ramped surfaces may be formed by angled tongues or the like cut from the return walls. In yet further alternative embodiments, the rail may be provided with resiliently deformable, parallel return walls without ramped surfaces, the return walls deforming resiliently to allow the projections to enter the recesses.

Each pale may be solid or tubular and may have a round or non-round cross-section. It will be appreciated that the return walls, the central wall or side walls, or the whole of the rail may be arranged to deform resiliently to aid assembly. Alternatively, individual resilient tongues or the like may be provided adjacent each recess, either integrally with the rail or by means of attached clips or the like which form part of the rail.

Although it is preferred to provide two recesses in each rail for receiving two projections on each pale as shown, it is also possible to provide only one projection and one recess for pivotably attaching the pale to the rail; the pale wall opposite the single projection may then be supported by the edge of the aperture in the central wall. Alternatively for example, the single recess and projection might be arranged on the longitudinal axis of the rail. In such embodiments, rather than two return walls, only one return wall might be provided.

In yet further alternative embodiments, each pale can be attached to only one rail, the other rail being of a similar or different construction; more than two rails may also be provided.

Conventional resilient clips, such as wire clips which are inserted into one end of the hollow pale so that their ends project through holes in the pale wall, may be used in place of the spring assemblies 20. Fixed, rigid pins or spring assemblies may also be inserted into the pales prior to insertion of the pales into the rails, in which case the pins may be inserted into one or each rail through the longer dimension of the aperture 37 or otherwise through the base of the rail. Alternatively, each pale may be provided with one or more projections, for example by cutting or embossing its outer wall. However, such arrangements are less preferred since the pre-installed projections may make it impractical to install the pales in situ after attaching the rails to the posts. Moreover, by inserting the pales through the rails before inserting the inserts through the pales, the inserts may advantageously be made longer than the longer dimension of the apertures 37 in the central wall of the rail, so that in the unlikely event of an insert being released within one of the rails, it will still prevent the pale from being pulled up through the aperture.

In summary, a preferred embodiment provides a self-raking fence panel comprising a pair of invert, U-shaped rails, each preferably comprising a unitary steel section having a horizontal central wall with apertures for receiving a plurality of pales, a pair of outer side walls, and rigid or resilient, integral internal return walls defining downwardly diverging ramped surfaces and a pair of recesses adjacent each aperture. The pales are provided with spring biased pins which are compressed by the ramped surfaces as the pale is pushed up through the respective aperture until the pins lock in the recesses. Alternatively, the pales may have rigid pins which urge the return walls outwardly as the pale is raised until the pins enter the recesses. The fence may be supplied as a kit of parts and assembled on site by fixing the rails to the posts, setting the posts in the ground, and then populating the rails with the pales.

Many further adaptations will be evident to those skilled in the art within the scope of the claims.

The invention claimed is:

1. A self-raking fence panel, comprising;
- a plurality of pales; and
- at least two rails;
- at least one of the rails comprising an elongate member having:
  - a central wall,
  - two integral, opposed side walls extending from the central wall, and
  - at least one return wall integral with a respective side wall, the return wall being arranged between the side walls and extending towards the central wall;
- the central wall having a plurality of apertures therein for receiving the pales;
- each pale having at least one projection extending laterally therefrom;
- the return wall having a plurality of recesses, at least one recess being arranged adjacent each respective aperture,
- each recess being adapted to receive a respective projection of a respective one of the pales such that the pale is pivotably adjustable about the said projection with respect to the rail; and
- the return wall comprising a ramped surface adjacent each recess, the ramped surface being arranged to slidingly engage an axial end face of the projection so as to assist the projection to enter the recess during assembly;
- wherein the rail includes a pair of said return walls, the return walls converging towards the central wall to define opposed ramped surfaces which extend axially along the rail, and the opposed ramped surfaces being arranged to engage opposite axial end faces of each projection so as to assist the projection to enter said recess in each return wall during assembly.

2. A panel according to claim 1, wherein the opposed ramped surfaces of the return walls are curved.

3. A panel according to claim 1, wherein the return walls define opposed parallel portions, and the recesses are formed in the opposed parallel portions.

4. A panel according to claim 1, wherein the rail is resiliently deformable so as to allow the axial end face of each projection to slide along the respective ramped surface and outwardly deform the respective return wall and then to enter the corresponding recess as the respective return wall springs back into a rest position during assembly.

5. A panel according to claim 4, wherein the return walls are spaced apart at rest by a minimum distance which is less than a corresponding transverse dimension of a pale, such that the pale is resiliently gripped between the return walls after assembly.

6. A panel according to claim 5, wherein the return walls define opposed, further ramped surfaces adjacent the central wall, the further ramped surfaces diverging towards the central wall so as to receive an end of a pale as the pale is inserted into the rail via the respective aperture in the central wall during assembly.

7. A panel according to claim 1, wherein the rail is resiliently deformable so as to allow the axial face of each projection to slide along the respective ramped surface and outwardly deform the respective return wall and then to enter the corresponding recess as the respective return wall springs back into a rest position during assembly.

8. A panel according to claim 1, wherein the at least one projection is resiliently biased.

9. A panel according to claim 1, wherein the at least one projection comprises an insert, and the insert is adapted to be inserted laterally into the pale via an aperture arranged on a transverse axis of the pale when the pale is assembled to the rail.

10. The panel according to claim 1, wherein each of the rails is rigid.

11. The panel according to claim 10, wherein the at least one projection comprises a spring disposed between the opposing axial end faces of the projection.

12. The panel according to claim 11, wherein, during assembly, the spring is configured to compress upon the axial end faces of the projection slidingly engaging the corresponding ramped surfaces, and the spring is configured to expand upon the axial end faces of the projection entering the corresponding recesses.

13. A kit of parts for a self-raking fence panel, including a plurality of pales, a plurality of inserts, and at least two rails;

each insert being adapted to be inserted laterally into a pale via an aperture arranged on a transverse axis of the pale such that at least one end of the insert extends from the pale to form a projection;

at least one of the rails comprising an elongate member having:

a central wall, two integral, opposed side walls extending from the central wall, and at least one return wall integral with a respective side wall, the return wall being arranged between the side walls and extending towards the central wall, the central wall having a plurality of apertures therein for receiving the pales;

the return wall having a plurality of recesses, at least one recess being arranged adjacent each respective aperture, each recess being adapted to receive a respective projection extending laterally from a respective one of the pales such that the pale is pivotably adjustable about said projection with respect to the rail;

the at least one return wall comprising a ramped surface adjacent each recess, the ramped surface being arranged to slidingly engage an axial end face of the projection so as to assist the projection to enter the recess during assembly;

wherein the rail includes a pair of said return walls, the return walls converging towards the central wall to define opposed ramped surfaces which extend axially along the rail, and the opposed ramped surfaces being arranged to engage opposite axial end faces of each projection so as to assist the projection to enter said recess in each return wall during assembly.

14. A kit of parts according to claim 13, wherein each insert is resiliently biased.

15. A self-raking fence panel, comprising:

a plurality of pales; and at least two rails;

at least one of the rails comprising:

an elongate member having a central wall, two integral, opposed side walls extending from the central wall, and at least one return wall integral with a respective side wall, the return wall being arranged between the side walls and extending towards the central wall;

each pale having a rigid projection or a pair of oppositely directed rigid projections extending rigidly therefrom so that together with the pale the projection or the pair of said projections has a fixed length transverse to a length direction of the pale;

the central wall having a plurality of apertures therein for receiving the plurality of pales, the at least one return wall having a plurality of recesses, at least one recess being arranged adjacent each respective aperture, each recess being adapted to receive one said rigid projection extending rigidly from a respective one of the pales so that the pale is pivotably adjustable about said projection with respect to the rail;

wherein the at least one of the rails is resiliently deformable to allow the projection to resiliently outwardly deform the return wall and then to enter the corresponding recess as the respective return wall springs back into a rest position during assembly; and wherein the rail includes a pair of said return walls, the return walls converging towards the central wall to define opposed ramped surfaces which extend axially along the rail, and the opposed ramped surfaces being arranged to engage opposite axial end faces of each projection so as to assist the projection to enter said recess in each return wall during assembly.

16. A kit of parts for a self-raking fence panel, including a plurality of pales, a plurality of rigid inserts, and at least two rails;

each insert having two oppositely directed ends;

each insert being adapted to be inserted laterally into a pale via an aperture arranged on a transverse axis of the pale such that one or each of the ends of the insert extends from the pale such that the insert forms a projection or a pair of oppositely directed projections;

at least one of the rails comprising an elongate member having:

a central wall, two integral, opposed side walls extending from the central wall, and at least one return wall integral with a respective side wall, the return wall being arranged between the side walls and extending towards the central wall, the central wall having a plurality of apertures therein for receiving the pales;

the at least one return wall having a plurality of recesses, at least one recess being arranged adjacent each respective aperture, each recess being adapted to receive one respective said projection extending laterally and rigidly from a respective one of the pales so that together with the pale the said projection or pair of oppositely directed projections has a fixed length transverse to a length direction of the pale and the pale is pivotably adjustable about said projection with respect to the rail;

wherein the at least one of the rails is sufficiently resiliently deformable to allow the projection extending rigidly from the pale to resiliently outwardly deform the return wall and then to enter the corresponding recess as the respective return wall springs back into a rest position during assembly; and wherein the rail includes a pair of said return walls, the return walls converging towards the central wall to define opposed ramped surfaces which extend axially along the rail, and the opposed ramped surfaces being arranged to engage opposite axial end faces of each projection so as to assist the projection to enter said recess in each return wall during assembly.

17. A method of assembling a self-raking fence panel, the panel comprising a plurality of pales, a plurality of inserts, and at least two rails; each pale having at least one hole arranged on a transverse axis thereof; at least one of the rails comprising an elongate member having a central wall, two integral, opposed side walls extending from the central wall, and a pair of return walls, each return wall being integral with a respective side wall, the return walls being arranged between the side walls and converging towards the central wall to define opposed ramped surfaces which extend axially along the rail, the central wall having a plurality of apertures therein, each return wall having a plurality of recesses, each recess being arranged adjacent a respective aperture; the method comprising:

a) arranging the rails in parallel, and then b) inserting a pale through a respective aperture in each of the rails so that the at least one hole lies outside said one of the rails; and then c) inserting at least one insert laterally into the pale via the at least one hole such that opposite ends of the insert project laterally from the pale; and then d) displacing the pale axially so that respective axial end faces of the opposite ends of the insert are progressively slidingly engaged between the opposed ramped surfaces of the return walls; and then e) continuing to displace the pale until the opposite ends of the insert enter into respective recesses in said return walls;

wherein the rail includes a pair of said return walls, the return walls converging towards the central wall to define opposed ramped surfaces which extend axially along the rail, and the opposed ramped surfaces being arranged to engage opposite axial end faces of each projection so as to assist the projection to enter said recess in each return wall during assembly.

18. A method according to claim 17, wherein step b) comprises:

b i) inserting each pale through an aperture in an upper one of the rails so that a lower end of the pale lies outside a lower one of the rails; and then b ii) displacing the pale axially so as to position its lower end between the upper and lower rails; and then b iii) inserting the lower end of the pale through a corresponding aperture in the lower rail.

19. A method of installing a fence, the fence comprising a plurality of self-raking panels supported by a plurality of posts; each panel comprising a plurality of pales, a plurality of inserts, and at least two rails; each pale having at least one hole arranged on a transverse axis thereof; at least one of the rails comprising an elongate member having a central wall, two integral, opposed side walls extending from the central wall, and a pair of return walls, each return wall being integral with a respective side wall, the return walls being arranged between the side walls and converging towards the central wall to define opposed ramped surfaces which extend axially along the rail, the central wall having a plurality of apertures therein, each return wall having a plurality of recesses, each recess being arranged adjacent a respective aperture; the method comprising, for each panel:

a i) fixing a rail between a respective pair of posts, wherein at least one of the pair of posts is not fixed in the ground; and then a ii) fixing the at least one of the posts in the ground; and then b) inserting a pale through a respective aperture in each of the rails so that the at least one hole lies outside said one of the rails; and then c) inserting at least one insert laterally into the pale via the at least one hole such that opposite ends of the insert project laterally from the pale; and then d) displacing the pale axially so that respective axial end faces of the opposite ends of the insert are progressively slidingly engaged between the opposed ramped surfaces of the return walls; and then e) continuing to displace the pale until the opposite ends of the insert enter into respective recesses in said return walls;

wherein the rail includes a pair of said return walls, the return walls converging towards the central wall to define opposed ramped surfaces which extend axially along the rail, and the opposed ramped surfaces being arranged to engage opposite axial end faces of each projection so as to assist the projection to enter said recess in each return wall during assembly.

20. A method according to claim 19, wherein step b) comprises:

b i) inserting each pale through an aperture in an upper one of the rails so that a lower end of the pale lies outside a lower one of the rails; and then b ii) displacing the pale axially so as to position its lower end between the upper and lower rails; and then b iii) inserting the lower end of the pale through a corresponding aperture in the lower rail.

* * * * *